US005362217A

United States Patent [19]

Jetzer et al.

[11] Patent Number: 5,362,217

[45] Date of Patent: Nov. 8, 1994

[54] HELICAL POSITIVE-DISPLACEMENT MACHINE HAVING A MEANDERING SEALING STRIP GROOVE

[75] Inventors: Gregor Jetzer, Nussbaumen; Roland Kolb, Regensdorf; Fritz Spinnler, Mellingen, all of Switzerland

[73] Assignee: Aginfor AG fur industrielle Forschung, Wettingen, Switzerland

[21] Appl. No.: 144,410

[22] Filed: Nov. 2, 1993

[30] Foreign Application Priority Data

Nov. 7, 1992 [DE] Germany ..... 4237663

[51] Int. Cl.[5] ..... F04C 18/04; F04C 27/00; F16J 15/16

[52] U.S. Cl. ..... 418/55.4; 418/142; 277/189; 277/204

[58] Field of Search ..... 418/55.4, 142; 277/204, 277/189

[56] References Cited

U.S. PATENT DOCUMENTS 3,994,636 11/1976 McCullough et al. ..... 418/55.4
4,869,658 9/1989 Tsutsumi et al. ..... 418/55.4
5,105,634 4/1992 Utter ..... 418/55.4

FOREIGN PATENT DOCUMENTS 2603462 3/1982 Germany .
62-118082 5/1987 Japan ..... 277/204
2-9975 1/1990 Japan ..... 418/55.4

OTHER PUBLICATIONS

Patent Abstracts of Japan, M-951, vol. 14, No. 144, Mar. 19, 1990.
Patent Abstracts of Japan, M-885, vol. 13, No. 477, Oct. 27, 1989.
Patent Abstracts of Japan, M-766, vol. 12, No. 442, Nov. 21, 1988.

*Primary Examiner*—John J. Vrablik
*Attorney, Agent, or Firm*—Burns, Doane, Swecker & Mathis

[57] ABSTRACT

In a positive-displacement device for compressible media with a helically-shaped conveying chamber disposed in a stationary housing, a helically-shaped positive-displacement body is associated with the conveying chamber. The body is maintained on a disk-shaped rotor which can be eccentrically driven in relation to the housing in such a way that during operation, each one of its points performs a circular movement which is limited by the circumferential walls of the conveying chamber. The front faces of the positive-displacement body adjoining one lateral wall of the conveying chamber are provided with a groove into which a sealing strip, consisting of a resilient material which is capable of gliding, is inserted. The groove has at least partially a meander-like extent.

2 Claims, 2 Drawing Sheets

HELICAL POSITIVE-DISPLACEMENT MACHINE HAVING A MEANDERING SEALING STRIP GROOVE

FIELD OF THE INVENTION

The invention relates to a positive-displacement device for compressible media with at least one helically-shaped conveying chamber disposed in a stationary housing, and with a helically-shaped positive-displacement body associated with the conveying chamber. The body is maintained on a disk-shaped rotor which can be eccentrically driven in relation to the housing in such a way that during operation, each one of its points performs a circular movement which is limited by the circumferential walls of the conveying chamber, and the curvature of the body is of such a dimension in relation to that of the conveying chamber that it nearly touches the interior and exterior circumferential walls of the conveying chamber at respectively one seal line which continuously progresses during operation. The front faces of the positive-displacement body adjoining one lateral wall of the conveying chamber are provided with a groove into which a sealing strip, consisting of a resilient material which is capable of gliding, is inserted.

BACKGROUND OF THE INVENTION

Positive-displacement machines of a helical construction are known from German Patent Publication DE-C-26 03 462. A compressor designed in accordance with this principle is distinguished by nearly pulse-free conveying of the gaseous work medium, for example consisting of air or an air-fuel mixture. For this reason it could also be advantageously employed, among other things, for charging purposes in internal combustion engines. During the operation of such a compressor, a plurality of approximately sickle-shaped work chambers are enclosed along the positive-displacement chamber between the helically-embodied positive-displacement body and the two circumferential walls of the positive-displacement chamber, which move from the inlet through the positive-displacement chamber to the outlet. In the course of this their volume is increasingly decreased, along with a corresponding increase of the work medium pressure. In this connection, the seal between the work chambers upstream and downstream of the compressor is of decisive importance.

A positive-displacement machine of the previously mentioned type is known from U.S. Pat. No. 3,994,636. To obtain an efficient radial seal between the front faces of the positive-displacement device and the lateral walls of the conveying chamber, it is necessary to provide an effective axial contact between the two elements. For this purpose, the positive-displacement device is provided with a groove on its front face, which forms the seat for a sealing strip inserted therein. This sealing strip consists of a resilient material, capable of gliding, and is of such a size that it can be moved in the groove axially and slightly radially. A force-exerting spring element underlies the sealing strip.

The groove causes a perfect lateral guidance of the sealing strip inserted therein. Positioning of the sealing strip in the longitudinal direction takes place through the ends of the groove cut into the helically-shaped walls. Positioning performed in this manner suffices for the loads exerted during operation on the sealing strip inserted in the housing. The sealing strip is sufficiently "caught". Acceleration forces, which are caused by the circulating movement of the helical machine, act during operation on the sealing strip inserted into the grooves disposed on the front face of the helically-shaped strips. These loads have a circulating effect on the sealing strips, i.e. in respect to the sealing strip, the inertial forces do not act on it in one direction, but circularly in the plane of the sealing strip groove. The reaction forces on the sealing strip change their direction accordingly. The transverse components can be well provided by the lateral walls of the groove; the sealing strip is moved forward and back in the groove by the longitudinal component of the reaction forces, in the course of which the ends of the groove form the stop for the relative movement.

The described reaction forces increase with higher operational rpm, wherein in particular the described longitudinal guidance of the sealing strip, which corresponds to the prior art, no longer suffices for the occurring reaction forces. The longitudinal component, which continuously changes its direction, leads to a back-and-forth movement of the sealing strip in the groove, which may result in increased wear of the sealing strips or of the walls of the groove.

OBJECT AND SUMMARY OF THE INVENTION

It is therefore the object of the invention to embody the groove of a rotating piston positive-displacement machine in respect to improved longitudinal guidance of the sealing strip and a reduction of the wear symptoms.

This object is attained in accordance with the invention in that the groove which receives the sealing strip necessary for sealing the conveying chamber in the axial direction at least partially extends in a meander-like fashion.

The advantage of the invention consists, on the one hand, in the effectiveness of the new shape of the groove and, on the other, in the simplicity of its production. This effectiveness is the result of the sealing strip being originally produced as a straight component and that, after insertion, by its resilience it is secured in the longitudinal direction of the sealing strip groove.

It is particularly practical if the sealing strip groove is only embodied with the meander-like extent on the outlet end. Because of this, it is possible to keep the radial space requirements within limits.

BRIEF DESCRIPTION OF THE DRAWINGS

An exemplary embodiment of the invention is schematically illustrated in the drawings, wherein.

DETAILED DESCRIPTION OF THE PREFERRED EMBODIMENT

Figure 1:
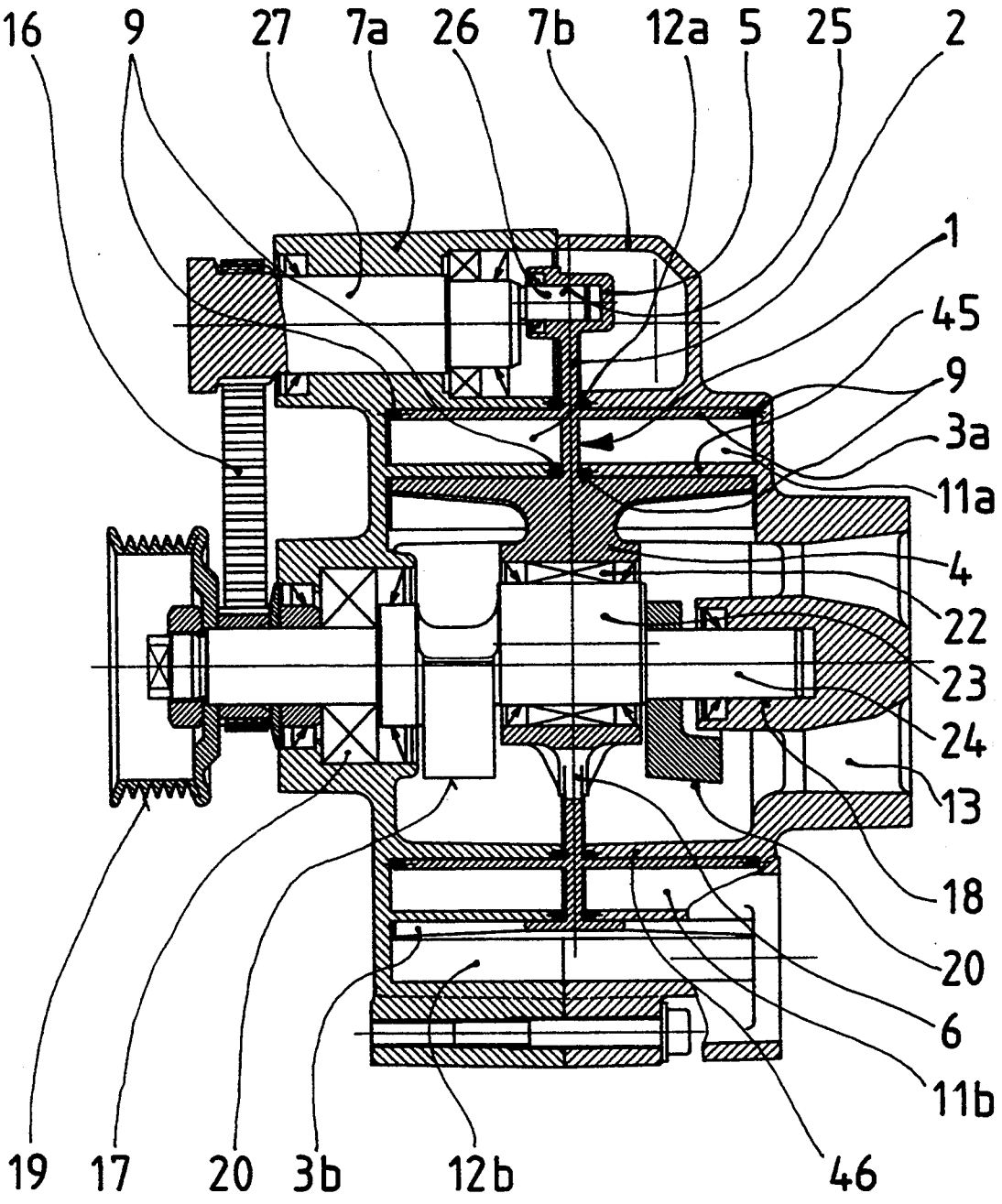
FIG. 1 shows a longitudinal section through a positive-displacement machine.
Figure 3:
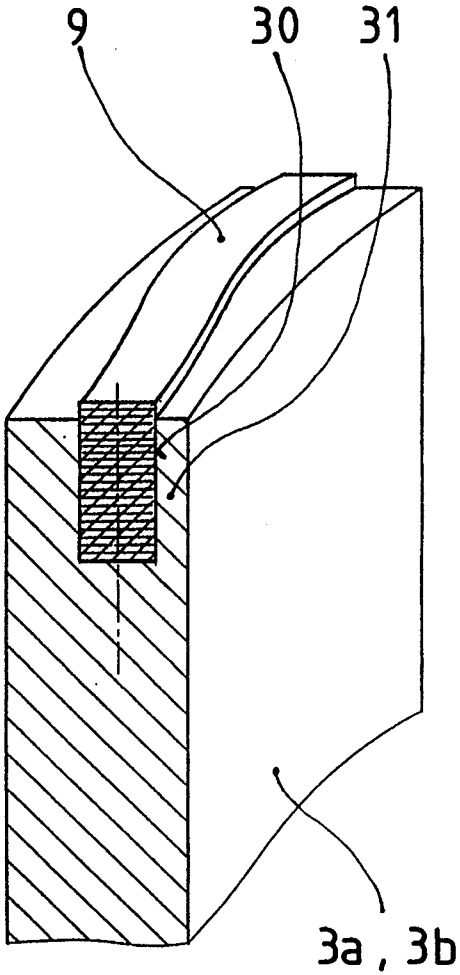
FIG. 3 is a perspective view of a sealing strip inserted into a helical wall/strip.

Reference is made to German Patent Publication DE-C3-2 603 462 for the description of the mode of functioning of the compressor, which is not the subject of the invention. Only the structure of the machine and the course of the process which are necessary for understanding are briefly described in the following description.

The disk-shaped positive-displacement device of the machine is indicated by 1. Two helically extending strips, which are offset from each other by 180°, are disposed on both sides of the disk 2. These are the strips 3*a*, 3*b*, which are vertically maintained on the disk 2. In the example shown, the helices themselves are formed by a plurality of arcs following each other in succession.

A hub is designated by 4, on which the disk 2 is seated by means of a rolling bearing 22 on an eccentric disk 23. This disk itself is a part of the main shaft 24. An eye 5 is disposed radially outside of the strips 3*a*, 3*b*, for receiving a guide bearing 25 drawn up on an eccentric bolt 26. The latter itself is a part of a guide shaft 27. Four through-openings 6 are provided in the disk at the helix end, so that the medium can reach one side of the disk from the other, to be drawn off through a central outlet 13 arranged only on one side.

The housing is composed of two halves 7*a*, 7*b*. Two conveying chambers 11*a* and 11*b* are respectively offset from each other by 180°, which are cut in the shape of a helical slit into the two housing halves, forming the ridges 45, 46. They extend from each one of inlets 12*a*, 12*b*, disposed in the housing on the outer circumference of the helix, to an outlet 13 common to both conveying chambers and provided in the interior of the housing. They essentially have parallel cylinder walls disposed at a fixed distance from each other which, as with the positive-displacement bodies of the disk 2, include a helix of 360°. The positive-displacement bodies 3*a*, 3*b*, the curvature of which must be of such dimensions that the strips almost touch the interior and exterior cylinder walls of the housing at several, for example two, places each, extend between these cylinder walls. Seals 9 have been inserted into appropriate grooves 30 on the free front faces of the strips 3*a*, 3*b* and the ridges 45, 46. The lateral walls of the housing are respectively sealed against the positive-displacement disk by the seals.

The two eccentric arrangements 23, 24 or 26, 27 provide the drive and guidance of the positive-displacement device 1. The main shaft is seated in a rolling bearing 17 and a sliding bearing 18. At its end projecting out of the housing half 7*b*, the shaft is provided with a V-belt pulley 19 for driving. Counterweights 20 are disposed on the shaft to compensate for the mass forces generated by the eccentric drive of the rotor. The guide shaft 27 is seated inside the housing half 7*b*.

The two eccentric arrangements are synchronized at exact angles in order to obtain a definite guidance of the rotor in the dead center positions. This is provided via a toothed belt drive 16. During operation, the double eccentric drive assures that all points of the positive-displacement disk, and thus also all points of the two strips 3*a*, 3*b*, perform a circular displacement movement. Because of the repeated alternating approach of the strips 3*a*, 3*b* to the interior and exterior cylinder walls of the associated conveying chambers, sickle-shaped work chambers enclosing the work medium result on both sides of the strips, which are displaced through the conveying chambers in the direction toward the outlet in the course of the positive-displacement disk being driven. During this, the volumes of these work chambers are reduced and the pressure of the work medium is correspondingly increased.

Sealing of the conveying chambers against the housing halves takes place via the sealing strips 9. These are inserted into the grooves 30 disposed on the front faces of the strips 3*a*, 3*b* and the ridges 45, 46.

Figure 2:
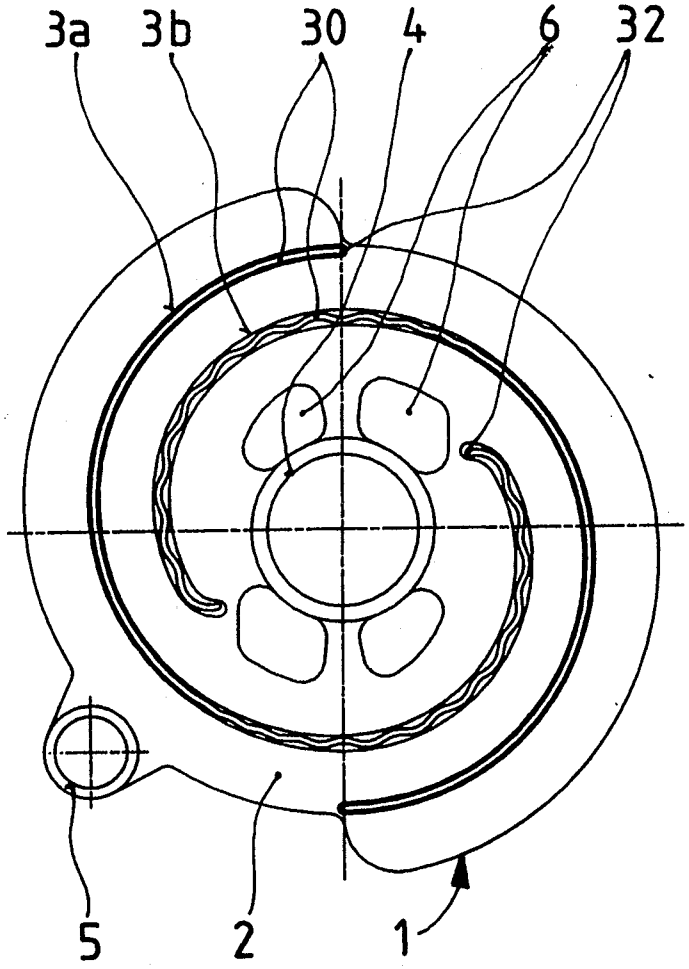
FIG. 2 is a front view of the positive-displacement body of the positive-displacement machine.

The grooves, not shown in detail, in the ridges 45, 46 of the conveying chambers extend approximately parallel to the helically-shaped walls. Guidance of the sealing strips in the radial direction is definitely provided by the groove walls 31. Guidance in the tangential direction is essentially only assured by the ends 32 (as shown in FIG. 2) of the sealing strip grooves.

In accordance with the invention, the sealing strip groove 30 of the positive-displacement device, which orbits along, is now no longer embodied parallel to the walls of the helically-shaped strips 3*a*, 3*b*, but is meander-like. The effect of the novel step consists in the tangential guidance or a damping of the tangential movement of the sealing strip.

As a rule, the sealing strip groove is cut into the front face of the wall of the positive-displacement device by a cleaving process. In the course of this, the positive-displacement device is rotated along the milling tool and the milling tool only performs the radial feed movement required for generating a helical shape. To produce the sealing strip groove of the invention, a radial back-and-forth movement must be superimposed on the radial feed movement of the milling tool. This does not represent a problem with the numerically-controlled processing machines customary today.

Insertion of the sealing strips into the sealing strip groove is also without problems. Because its meander-like extent only has a relatively small greatest distance from the center line of the groove, the sealing strip can be easily inserted into the groove of the invention.

In the case illustrated, the meander-like path of the sealing strip groove is limited, looking in the conveying direction, to the inner part of the helically-shaped strip 3*a*, 3*b* which extends over approximately 150° to 180°.

This is based on the following consideration: the meander-like path of the sealing strip entails an increased radial space requirement; the helically-shaped wall of the positive-displacement device must be widened. Along with the widening of the helically-shaped walls of the positive-displacement device over its entire length, a radial increase of the helical machine results, if no reduction of the conveying capacity is to be tolerated.

It has now been shown in tests that it is reasonable to provide the novel meander shape of the sealing strip groove only in those sections of the helically-shaped strips of the positive-displacement device in which the sealing strip groove of an embodiment in accordance with the prior art is endangered the most. This is the case with respect to the end of the sickle-shaped work chambers on the outlet side. There the gaseous work medium is compressed towards the cutlet, as previously described, during which the temperature of the work medium rises and, along with this, the temperature of the wall bounding the working chambers also rises.

Thus, limiting the meander shape to the outlet area of the helix results in that the radial dimensions of the helical machine need not be increased; thickening of the helically-shaped ridges only takes place in the area with the meander-like sealing strip groove and is oriented towards the interior of the machine in the radial direction. In spite of this, the secure operation of the sealing strip is assured.

While this invention has been illustrated and described in accordance with a preferred embodiment, it is recognized that variations and changes may be made without departing from the invention as set forth in the claims.

What is claimed is:

1. A positive-displacement device for compressible media of the type with at least one helically-shaped conveying chamber disposed in a stationary housing, and with a helically-shaped positive-displacement body associated with the conveying chamber, which body is maintained on a disk-shaped rotor eccentrically driven in relation to the housing so that during operation each point of the positive-displacement body performs a circular orbit which is limited by circumferential walls of the conveying chamber, and a curvature of the positive-displacement body is of such a dimension in relation to that of the conveying chamber, that the positive-displacement body nearly touches interior and exterior circumferential walls of the conveying chamber at respectively one seal line which continuously progresses during operation, wherein front faces of the positive-displacement body adjoining one lateral wall of the conveying chamber are provided with a groove into which a sealing strip, consisting of a resilient material which is capable of gliding, is inserted, the improvement wherein the groove receiving the sealing strip required for sealing the conveying chamber in an axial direction, formed as parallel to the positive-displacement body in a first part and meandering with a plurality of turns relative to the positive-displacement body in a second part;

an end face of the positive displacement body being wider in a region of the meandering course of the groove than in the region of the parallel course of the groove; and an elastic sealing strip, formed as a rectilinear, uncurved component, inserted in the groove.

2. A positive-displacement machine in accordance with claim 1, wherein the positive-displacement body is disposed on the rotor from a radially outer inlet to a radially inner outlet, the meandering second part of the sealing strip groove being limited to the radially inner part of the positive-displacement body and extends over approximately 150°.

* * * * *